US005119709A

United States Patent [19]

Suzuki et al.

[11] Patent Number: 5,119,709

[45] Date of Patent: Jun. 9, 1992

[54] INITIAL TOUCH RESPONSIVE MUSICAL TONE CONTROL DEVICE

[75] Inventors: Hideo Suzuki; Masao Sakama, both of Hamamatsu, Japan

[73] Assignee: Yamaha Corporation, Hamamatsu, Japan

[21] Appl. No.: 509,290

[22] Filed: Apr. 13, 1990

[30] Foreign Application Priority Data

Apr. 14, 1989 [JP] Japan ..... 1-95656
Apr. 14, 1989 [JP] Japan ..... 1-95657

[51] Int. Cl.[5] ..... G10H 1/053

[52] U.S. Cl. ..... 84/600; 84/658; 84/687

[58] Field of Search ..... 84/600, 615, 626, 658, 84/687-690, DIG. 7; 341/22, 27, 31-34

[56] References Cited

U.S. PATENT DOCUMENTS 4,414,537 11/1983 Grimes .
4,528,885 7/1985 Chihana ..... 84/658 X
4,627,324 12/1986 Zwosta .
4,635,516 1/1987 Giannini ..... 84/600
4,699,037 10/1987 Minamitaka et al. ..... 84/DIG. 7
4,700,605 10/1987 Minamitaka ..... 84/DIG. 7
4,920,848 5/1990 Suzuki .
4,979,423 12/1990 Watanabe ..... 84/690

FOREIGN PATENT DOCUMENTS 63-127773 5/1988 Japan .
2029070 8/1978 United Kingdom .

*Primary Examiner*—Stanley J. Witkowski
*Attorney, Agent, or Firm*—Graham & James

[57] ABSTRACT

A musical control device comprising a position detection device whereby the position of a portion of a performer's body is detected and output as a position signal, a velocity detection circuit whereby the velocity of the portion of the performer's body is detected and output as velocity data based on the change in the above mentioned position signal, and a musical control signal output circuit whereby a musical control signal is generated and output based on said position signal and velocity data.

9 Claims, 7 Drawing Sheets

INITIAL TOUCH RESPONSIVE MUSICAL TONE CONTROL DEVICE

BACKGROUND OF THE INVENTION

The present invention relates to control input means for electronic musical devices, and in particular relates to control means for electronic musical devices in which control is effected through movements of the performer's body.

In the past, various means have been proposed for converting body movements to input signals for electronic musical instruments and music generating devices. In general, with these devices the amount of flexion, extension, and rotation of various body articulations of a performer are detected by means of potentiometers, rotary encoders, displacement measurement means comprising piezoelectric elements employing ultrasound, or pressure sensing elements provided in the finger tip portion of gloves which are fitted on the performer's hands. In this way, signals representing the degree of flexing or extension, or the angle of rotation of a body articulation are used to control the various elements of a musical sound generating means.

With such a device, it is thus possible to control a musical sound generating means while performing dance, aerobics, and the like, converting body movements to musical control input signals through detecting the displacement of various body articulations.

With electric organs, synthesizers, and similar keyboard musical devices, musical control is effected based on "after-touch" (after-touch response) and "initial-touch" (initial-touch response). After-touch refers to key position control factors such as the depth to which an individual key is depressed (position), the pressure applied, and the like. Initial-touch refers to velocity control factors, that is, the velocity at which a key is depressed.

However, with the above described prior art control devices, control is limited to after-touch. Thus, in general, initial touch control based on the velocity of flexion, extension, and rotation of various body articulations is not possible with these conventional devices. For this reason, the finer nuances of a performance are not reflected in the music which is ultimately output from the musical device under control. Hence, more subtle shade of musical control cannot be achieved.

SUMMARY OF THE INVENTION

With the above limitations of the conventional control devices in mind, it is an object of the present invention to provide a musical control device through which not only after-touch control is possible, but which also offers initial-touch control, that is control based on the velocity of a performer's body movements. Accordingly, with the enhancements provided by the present invention, the finer shades of a performer's body movements are reflected in the musical output of the device under control, thus providing a richer and more refined musical output.

In order to achieve the above object, the musical control device of the present invention provides a position detection means whereby the position of a portion of the performer's body is detected and output as a position signal, a velocity detection means whereby the velocity for a portion of the performer's body is detected and output as velocity data based on the change of the above mentioned position signal, and a musical control signal output means whereby a musical control signal is generated and output based on the above mentioned position signal and velocity data. In this way, it is possible to effect musical control based on the velocity of a portion of a performer's body, thus making initial-touch control possible. Through this effect, musical control can be achieved which reflects the finer nuances of a performer's musical expression.

Additionally, by means of simple modifications, a conventional musical control device employing a position detection means similar to that of the present invention can be supplemented so as to include an initial-touch control function based on the output of the position detection means. Thus, a conventional musical control device can easily be adapted to achieve the musical control effects of the present invention.

DETAILED DESCRIPTION OF THE PREFERRED EMBODIMENTS

In the following section first preferred embodiment of the present invention will be explained in detail with reference to FIGS. 1 through 7.

Figure 1:
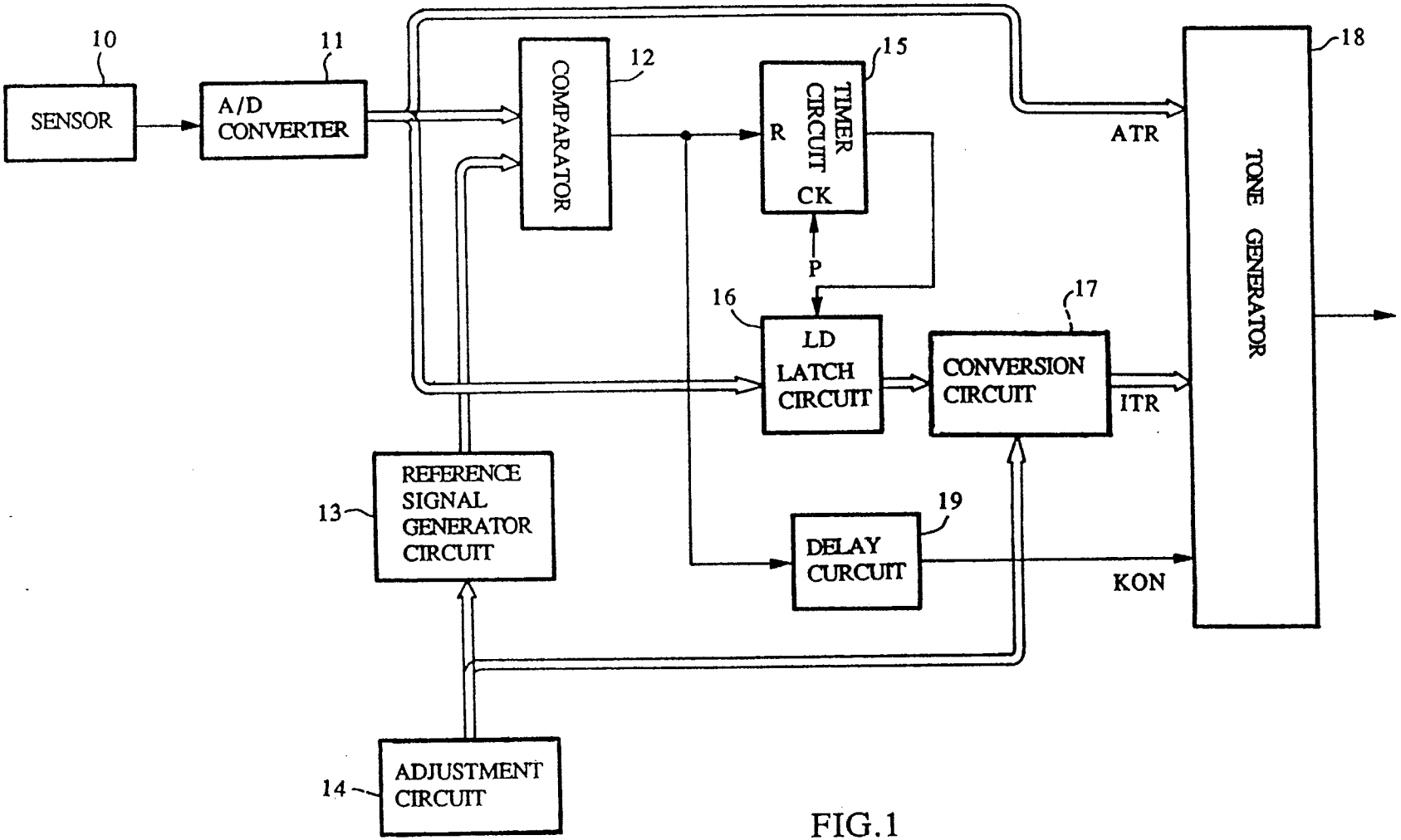
FIG. 1 is a block diagram of first preferred embodiment of the musical control device of the present invention.
Figure 2:
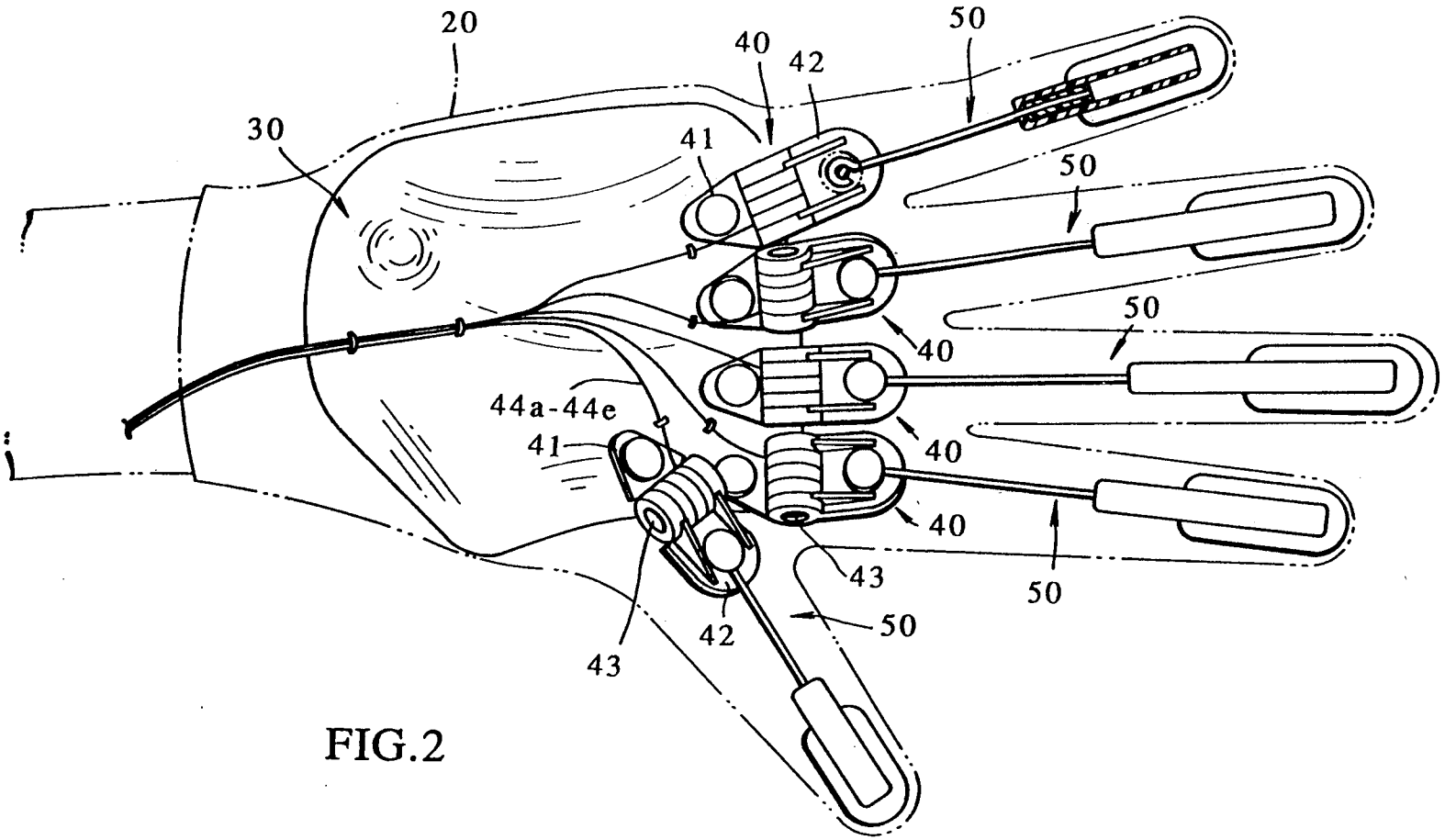
FIG. 2 is a plan view showing the palmar aspect of a glove-like component of the present invention for detecting the amount of flexion of a performer's digits.

FIG. 1 is a block diagram schematically illustrating the overall electronic layout of one preferred embodiment of the musical control device of the present invention. FIG. 2 shows the palmar aspect of a glove-like component of the present invention for detecting the amount of flexion of a performer's digits.

In the present preferred embodiment, a plurality of sensors 10 are incorporated in the glove-component shown in FIG. 2. Each sensor 10 is fabricated so as to be a pivotable unit which is applied in proximity to a respective digit of the performer. Based on the angle formed between a straight line parallel to the surface of the performer's palm and passing through a respective metacarpal-phalangeal articulation, and a straight line parallel to the respective digit and passing through the same metacarpal-phalangeal articulation, the amount of bending, that is, the amount of flexion of a performer's digit is detected. This amount of flexion is thus converted to an analog electrical signal, which is then provided to a respective A/D (analog-digital) converter 11.

To explain the sensors 10 more concretely, referring to FIG. 2, an articulation unit 40 of each sensor 10 is fixed to a base unit 30 which is provided between the two layers of a two-ply glove 20 so as to lie parallel to the performer's palm. Each of the five articulation units 40, one for each of the performer's digits, are provided fixed along the edge of base unit 30 which lies in proximity to the performer's metacarpal-phalangeal articulations. Each articulation unit 40 is in turn composed of a palm plate 41 and a digit plate 42 which are interconnected by a pin 43 so as to be pivotable in a plane perpendicular to the surface of the performer's palm, thus forming a hinge joint. Each hinge joint, comprised of a respective palm plate 41 and digit plate 42, is further provided with a variable resistance element (not shown in the drawings) which incorporates a sliding rotary unit. Via a respective lead 44(*a–e*), the resistance value detected by each variable resistance element, and hence a value reflecting the angle between each palm plate 41 and digit plate 42 is supplied to the respective A/D converter 11.

A respective elongated extender 50 is fixed to each digit plate 42 so as to lie approximately parallel to the respective digit, whereby flexion of a performer's digit causes the respective digit plate 42 to pivot with respect to the respective palm plate 41, by which means a value in accordance with the extent of flexion of the operator's respective digit is detected by the above mentioned variable resistance element. In this way, a value reflecting the extent of flexion of each of the performer's digits can be detected and output.

For the plurality of sensors described above, an electrical current is supplied to each variable resistance element of each sensor 10 by the respective lead 44(*a–e*). Using the voltage drop thereby created across each variable resistance element, a respective position signal is generated. The position signals thereby generated are thus in proportion to the extent of flexion of each of the performer's respective digits.

As mentioned above, each analog position signal is supplied by the respective lead 44(*a–e*) to a respective A/D converter 11, wherein a corresponding digital signal for each of the performer's digits is generated and output. Each digital position signal output from a respective A/D converter 11 is then supplied to a respective comparator 12, wherein a judgement is made whether the respective digit has flexed up to a predetermined position or not. A reference signal is supplied to each comparator 12 by a respective reference signal generator circuit 13, with which each digital position signal supplied from the respective A/D converter 11 is compared. Thus, when the signal indicating the amount of flexion of one of the performer's digits is greater than the value represented by the above mentioned reference signal, a judgement signal is output from the comparator 12 which is then supplied to a respective timer circuit 15 and delay circuit 19. The above mentioned reference signal represents a degree of flexion of the respective performer's digit corresponding to the position just after the onset of flexion from the fully extended position, and thus is a comparatively small value. The value of the reference signal can be adjusted by means of a respective adjustment circuit 14.

As mentioned above, each judgement signal is supplied to a respective timer circuit 15, to which it is connected by a reset terminal R. When a judgement signal is supplied to the reset terminal R of a respective timer circuit 15, counting of the clock pulses of a clock signal P input at a clock terminal CK commences and continues until a count corresponding to a predetermined time TO is judged to have passed. Accordingly, when a judgement signal is supplied to a timer circuit 15 from a respective comparator 12, or putting it differently, when a given digit has been judged to have flexed beyond a predetermined position, a count operation commences, whereby a timer signal is output from the respective timer circuit 15 indicating that a predetermined time TO has passed since onset of flexion of the respective digit. Because this predetermined time TO is later employed to determine the initial velocity of the respective digit, the time TO must be extremely small.

The above mentioned timer signal from timer circuit 15 is supplied to the load terminal LD of a respective latch circuit 16. Each latch circuit 16 also has data terminal which receives the output signal from the above described A/D converter 11. When a latch circuit 16 receives the above described timer signal, it latches the signal supplied from the respective A/D converter 11 at that moment. Accordingly, the data latched by the latch circuit 16 from the respective A/D converter 11 is a digital position signal which indicates the position of the respective digit after the above mentioned extremely small predetermined time TO has passed.

The data latched in each latch circuit 16 is subsequently supplied to a respective conversion circuit 17. Each conversion circuit 17 includes a data conversion table, whereby the latched data supplied from latch circuit 16 is converted to an initial touch response signal (hereafter referred to as ITR). As will be explained later, the above mentioned conversion circuit 17 is necessary whenever the circuitry includes the previously described adjustment circuit 14. Additionally, the conversion circuit 17 is sometimes necessary in order convert the latched data from latch circuit 16 to a form suited to the input characteristics of the tone generator 18 to which the output of conversion circuit 17 is supplied. In the case that the adjustment circuit 14 is eliminated from the present invention, and when the latched data from latch circuit 16 is suitable for direct input to the tone generator 18, then conversion circuit 17 is unnecessary.

As mentioned above, the latched data from each latch circuit 16 is supplied to a tone generator 18 as an ITR signal after passing through a respective conversion circuit 17 and undergoing suitable conversion there as necessary.

In addition to the ITR signals, key-on signals (referred to as KON signals hereafter) which will be described below, and after-touch response signals (referred to as ATR signals hereafter) are also supplied to tone generator 18. The generation of musical signals in the tone generator 18 is governed by the above mentioned KON signals. At the same time, the pitch, timbre, volume, and other tone related variables are controlled based on the above mentioned ITR signals and ATR signals.

In order to obtain the above mentioned KON signals, in the present preferred embodiment, the judgement signal from each comparator 12 is supplied to a respective delay circuit 19. The delay effected in each delay circuit 19 is approximately equal to the previously described predetermined time TO or very slightly longer. The reason for this is, after a judgement signal is supplied to a respective timer circuit 15, after time TO the timer circuit 15 supplies a timer signal to the respective latch circuit 16 which at that time latches a respective position signal. Thus, in this way, the delay circuit 19 can be made to output the judgement signal to the tone generator 18 at approximately the same the latching operation is carried out. Accordingly, it becomes possible to provide that KON signal is supplied to the tone generator 18 only after the latch has been updated.

Concerning the ATR signal, the output of each A/D converter 11 is supplied directly to the tone generator 18 as an ATR signal.

In the following section, the operation of the above described first preferred embodiment of the present invention will be explained in detail.

After a glove unit as shown in FIG. 2 is applied to each of the performer's hands, the plurality of sensors 10 are able to detect the amount of flexion of the performer's respective fingers, and to output appropriate signals based on the detected movement. These output analog position signals are then supplied to respective A/D converters 11, where they converted to respective digital position signals, which are then supplied to a respective comparator 12, a respective latch circuit 16, as well as to tone generator 18.

Figure 3:
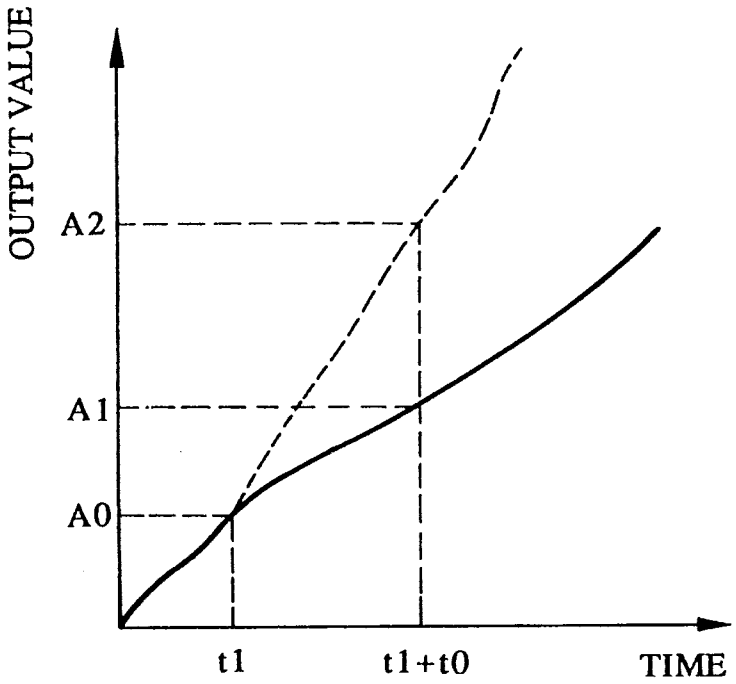
FIG. 3 is a graph showing the relationship between the analog position signal output from a position sensor of the present invention and elapsed time while a digit is being flexed of the first preferred embodiment of the present invention.
Figure 5:
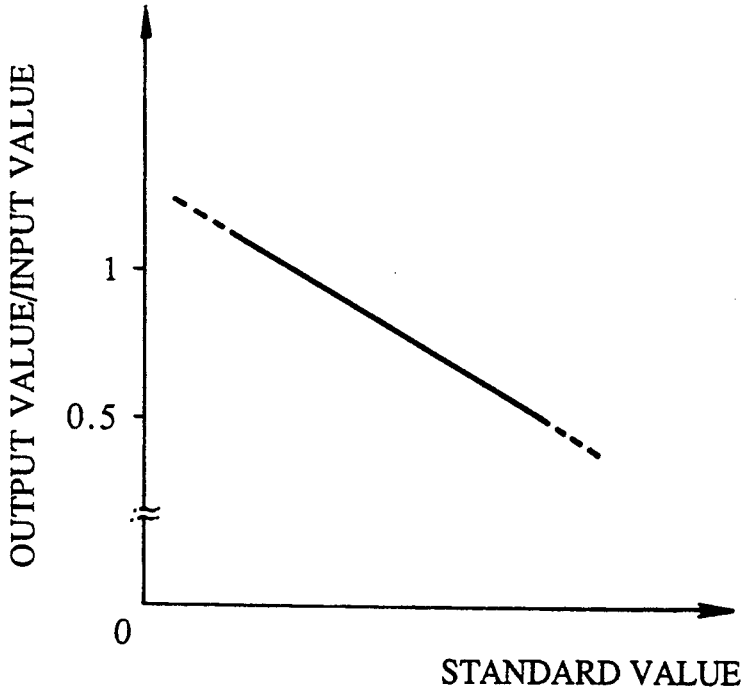
FIG. 5 is a graph illustrating the conversion ratio employed in a conversion circuit of the first preferred embodiment of the present invention.

Referring to FIG. 3, the relationship between the analog position signal value output from a sensor 10 and elapsed time (approximately proportionate to amount of flexion) while a flexion of the respective digit is being carried out can be seen.

While a digit is being flexed, the analog signal output from a sensor 10 gradually increases. It is when the value A0 is reached in the graph of FIG. 3, that the corresponding digital value supplied to comparator 12 results in comparator 12 recognizing the onset of flexion. Putting it differently, when the digital signal corresponding to the output of a sensor 10 is compared with a reference signal in comparator 12, the analog value corresponding to reference signal is A0, at which value the onset of flexion is acknowledged in comparator 12 by outputting a judgement signal, as previously described. In order to simplify the explanation, in the following discussion, the output of sensor 10 should be taken to represent the digital value output from an A/D converter 11 corresponding to the analog value actually output from the respective sensor 10.

The solid line in the graph of FIG. 3 represents a situation when the flexing of a digit is comparatively slow. In the graph, it can be seen that the output of the sensor 10 increases gradually with time, and at time t1, the value A0 is reached. At this point, a judgement signal is output from comparator 12, and the respective timer circuit 15 commences counting. Thus at reference time t1 (corresponding to the reference signal), the judgement signal is output from comparator 12 indicating the onset of flexion.

As the respective digit continues to flex, the output of sensor 10 continues to increase. After an interval given by time t0 after the judgement signal has supplied to a respective timer circuit 15, that is, at time t1+t0, the timer circuit 15 supplies a timer signal to the respective latch circuit 16 which at that time latches a respective position signal. Because the respective digit is flexing comparatively slowly, the angle over which the digit flexes during the interval t0 is not very great, as is the corresponding value Al output from sensor 10 which is latched by latch circuit 16.

The broken line in the graph of FIG. 3 represents a situation when the flexing of a digit is comparatively rapid. In order to simplify the explanation, the same values of the above explanation are for value A0 output from sensor 10 near the onset of flexion and the corresponding time t1. Thus, as above, at time t1, the value A0 is reached.

At time t1, a judgement signal is output from comparator 12, and the respective timer circuit 15 commences counting. As above, after an interval given by time t0 after the judgement signal has supplied to a respective timer circuit 15, that is, at time t1+t0, the timer circuit 15 supplies a timer signal to the respective latch circuit 16 which at that time latches a respective position signal. In the present example, the respective digit is flexing comparatively rapidly. Thus, the angle over which the digit flexes during the interval t0 is comparatively large, as is the corresponding value A2 output from sensor 10 and latched by latch circuit 16.

Because A0 is a constant value, the actual displacement of the flexed digit can be known from the value latched by latch circuit 16, that is, A1 for the example of a slowly moving digit, and A2 for the example of a rapidly moving digit. Further, because the respective latched values are latched after a fixed, predetermined time interval, the velocity of the flexing digit can be determined from the values latched by latch circuit 16.

Because the value A0 is very close to the onset of flexion, it can be seen from the above discussion that the values latched by latch circuit 16 are nearly directly proportional to the average velocity of the flexing digit. Thus, when these latched values are appropriately adjusted to match the input characteristics of the tone generator 18 by a respective conversion circuit 17, the value provided to tone generator 18 correspond to the previously described ITR signal.

As previously mentioned, the reference value supplied to comparator 12 can be adjusted by adjustment circuit 14. However, when ever this value is changed, it becomes necessary to modify the conversion table used in conversion circuit 17.

Figure 4:
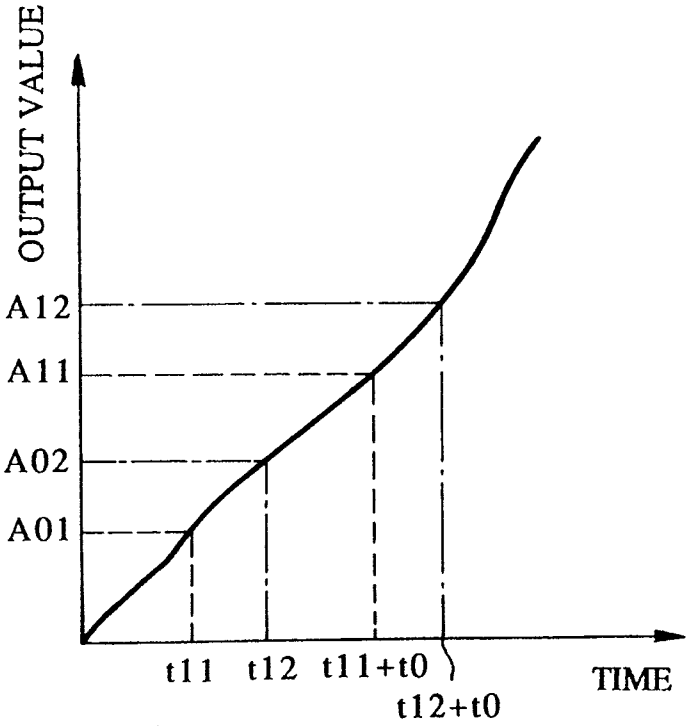
FIG. 4 is a graph showing the relationship between the analog position signal output from a digit flexion sensor of the present invention and elapsed time while a digit is being flexed, illustrating the effect of changing a reference value.

In FIG. 4, the effect on the data latched by latch circuit 16 by changing the value of the reference value is shown, with the velocity of the flexing digit identical in each case.

In FIG. 4, the lowest value shown for the reference value is A01, and the corresponding time at which sensor 10 detects this value is t11. After the fixed interval t0 has passed, that is, at time t11+t0, the value A11 is detected by sensor 10 and is latched by latch circuit 16. Also shown in FIG. 4, when the reference value is changed to a larger reference value A02, the corresponding time t12 at which the output of sensor 10 exceeds the reference value A02 occurs somewhat later than time t11. In the case of reference value A02, after the fixed interval t0 has passed, that is, at time t12+t0, the value A12 is detected by sensor 10 and is latched by latch circuit 16. In both cases of the above described cases for different reference values, that is, A01 and A02, the velocity of the flexing digit and the fixed interval t0 are the same. That being so, time t12+t0 necessarily must be later than time t11+t0, and accordingly, the value A12 must necessarily be greater than the value A11. Thus it can be seen, that when the reference value is increased while all other factors are the same, the time when the output of sensor 10 exceeds the reference value at which time timer circuit 15 begins counting the fixed interval t0 must necessarily be later. Accordingly, the latching operation which occurs after the fixed interval t0 must necessarily be later, and hence the value output from sensor 10 which is latched must necessarily be larger. For this reason, it becomes necessary to modify the conversion table in conversion circuit 17 whenever the reference value is changed in order to provide standardized data to tone generator 18. Thus, for a smaller reference value, the conversion table is modified so as to proportionately increase the value of the data latched by latch circuit 16, and conversely, for a larger reference value, time conversion table is modified so as to proportionately decrease the value of the data latched by latch circuit 16, which is graphically illustrated in FIG. 5.

For the conversion circuit 17, it is suitable to employ a conversion table coded in ROM (read only memory), to which the data latched by latch circuit 16 is provided as input data, and further to which address data is supplied from adjustment circuit 14, whereby the latched data is appropriately converted and supplied to tone generator 18. With such a conversion circuit 17, according to the data output from adjustment circuit 14, one appropriate conversion table is addressed out of the plurality of such tables encoded in the above mentioned ROM, whereby a suitable conversion table is prepared corresponding to the address data supplied by adjustment circuit 14. Because the signal output from the above described conversion circuit 17 is an ITR signal, musical expression can be achieved based on initial touch response generated from the performer's movements.

As described previously, based on the output from sensor 10 and hence from A/D converter 11, the comparator 12 makes a judgement as to whether a digit has flexed beyond a predetermined angle or not. Thus, the judgement signal which is output from comparator 12 and supplied to timer circuit 15 can be considered to be the previously mentioned KON signal. However, when latch circuit 16 latches a new data value, the value is latched after the counting operation of timer circuit 15 which was triggered by the judgement signal has been completed. Accordingly, if the judgement signal output from comparator 12 is used directly as a KON signal, the ITR signal which has been latched by latch circuit 16 and is then supplied to the tone generator 18 via conversion circuit 17 is the ITR signal latched due to the preceding judgement signal. For this reason, the judgement signal output from comparator 12 is delayed in delay circuit 19 for a time interval at least as long as that of the counting operation of timer circuit 15.

Concerning the ATR signal, because the commencement of the generation of a musical signal is controlled by the above mentioned KON signal, there is no problem even if the ATR signal is generated and supplied directly to the tone generator 18 prior to the KON signal. Through this effect, timed by the onset of a KON signal, the tone generator 18 commences the generation of a musical signal, and at the same time, based on the supplied ITR and ATR signals, control of the individual elements of the generated musical signal is carried out until a predetermined interval has passed after the onset of the KON signal, after which the amplitude of the output musical signal is diminished at an appropriate rate, and finally, the musical signal is terminated.

In the preferred example as described above, a timer circuit 15 is included wherein a time interval is determined by counting clock pulses. However, the present invention is in no way so limited, and accordingly, any appropriate time measuring means may be employed. For example, the output of the comparator 12 can be supplied to a delay circuit having a fixed delay period by which means a fixed interval can be timed. Similarly, a monostable multivibrator can be employed, wherein the interval from the onset of a pulse to the point where the pulse signal returns to the baseline is measured. In such a case, the initial upstroke of the pulse is detected, from which time the passage of a predetermined time interval can be judged.

As described earlier, each of the sensors 10 employs a sliding rotary variable resistance element. However, it is also acceptable to variable resistance elements wherein the resistance value is determined based on stretching, extension, or pressure changes. Also, rather than the various above described analog elements for determining the extent of digit flexion, a device providing a digital output can be employed, for example a digital rotary encoder, whereby the above mentioned A/D converter 11 can be eliminated. Furthermore, detection devices may be employed in which position signals are output at one or more points after which flexion past a predetermined angle has taken place, whereby the need for comparing the output signals with a reference signal in the comparator 12 can be eliminated.

Further, for the sensors 10, angle detection sensors having a plurality of output leads corresponding to various angles of rotation can be employed, whereby the output from a given lead corresponding to a predetermined angle is employed for the previously described judgement signal. With such an arrangement, each of the above mentioned plurality of output leads is connected to an encoder, the output of which is supplied directly to latch circuit 16 and thus forms the data which is latched therein. Accordingly, with such a sensing means, there is no need for the previously described A/D converter 11, comparator 12, and reference signal generator circuit 13.

Figure 6:
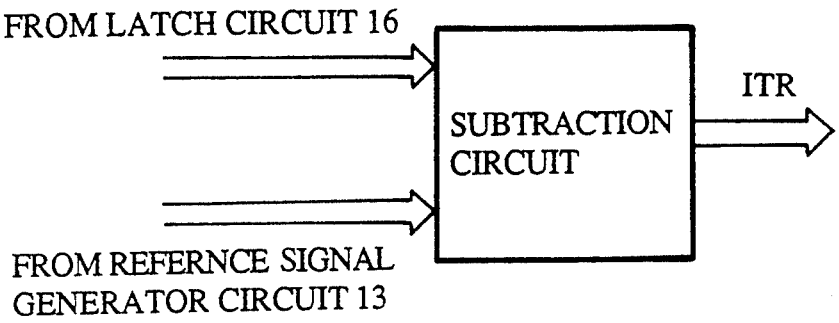
FIGS. 6 and 7 are block diagrams showing variations of a conversion circuit employed in the first preferred embodiment of the present invention.
Figure 7:
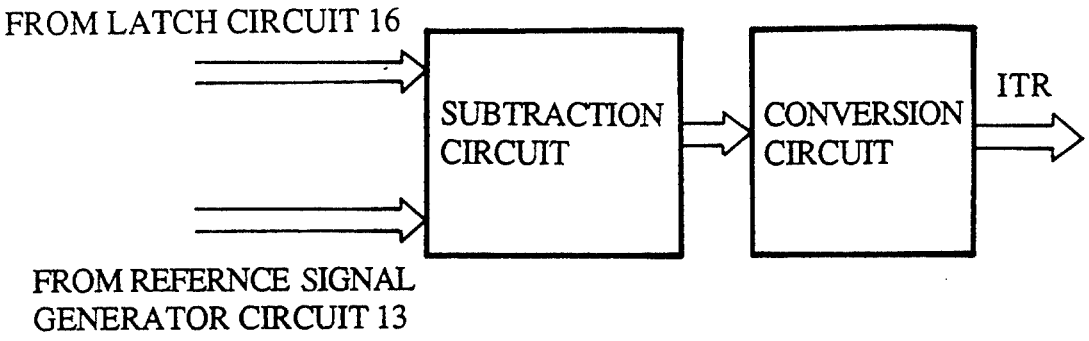

As described earlier, the conversion circuit 17 is required depending on whether the adjustment circuit 14 is included or not, and also depending on the input characteristics of the tone generator 18. With examples of the present invention that include the conversion circuit 17, various types of conversions can be accomplished. For example, as shown in FIG. 6, the conversion circuit 17 may consist of a subtraction circuit by which means the reference signal A0 (or a signal based on the output of adjustment circuit 14) is subtracted from the output of latch circuit 16, whereby a value is obtained that is proportional the velocity of the flexing digit. Similarly, as shown in FIG. 7, the output of the above described subtraction circuit may be further supplied to a conversion circuit where certain non-linear conversions are carried out based on characteristics of the supplied signal. For example, when the supplied signal is in a low velocity region, the produced ITR signal can be caused to be more sensitive to small changes in the velocity, whereas when the supplied signal is in a high velocity region, the produced ITR signal can be caused to be less sensitive to the velocity. Other examples include a variable conversion circuit in which the conversion ratio can be individualized to match the finger velocity characteristics of each performer.

For an ITR signal based on the velocity of a portion of a performer's body, the ITR signal can have a directly proportional relationship to the detected velocity, or an inversely proportional relationship. Further, it is also acceptable for the ITR signal and velocity to have a fixed corresponding relationship.

By supplying the previously described KON signal to reference signal generator circuit 13, and by causing the value of reference signal A0 to be slightly reduced during the interval when the KON signal is being output, it is possible to create a hysteresis effect on the detection of on-off states during the detection of musical timing signals. That is to say, by causing the value of the reference signal A0 when a KON signal changes from on to off to be slightly lower than when the KON signal changes from off to on, judgement errors can be reduced.

In the first preferred embodiment as described above, separate circuitry was employed for each sensor. Thus for a musical control device with control based on the movement of five digits of one hand, five sets of detection circuitry would be required. However, by using time-slicing techniques, it is possible to configure the musical control device of the present preferred embodiment in which only one circuit is employed for a plurality of sensors.

In the following section, a second preferred embodiment of the present invention will be explained in detail with reference to FIGS. 8 through 10.

Figure 8:
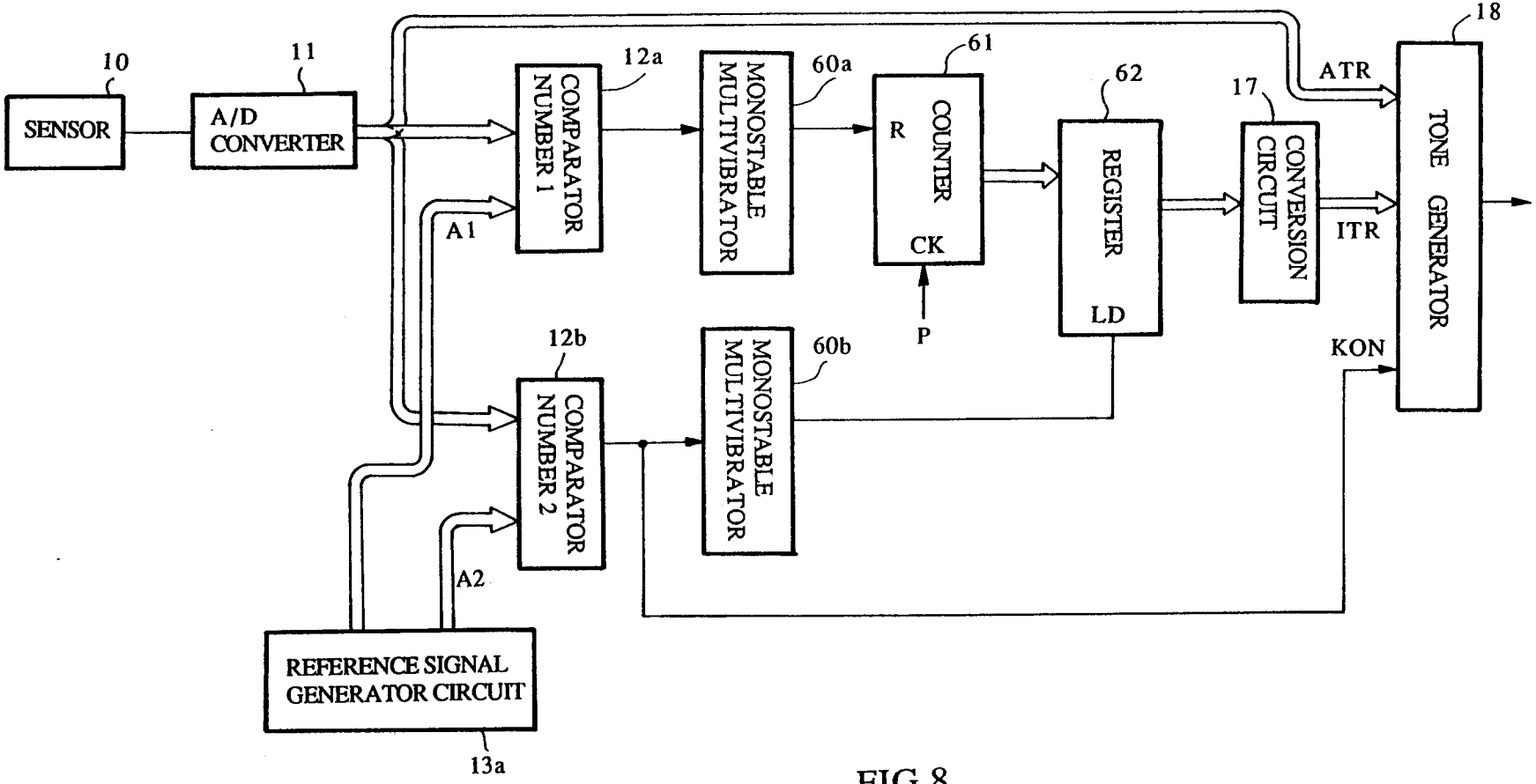
FIG. 8 is a block diagram of a second preferred embodiment of the musical control device of the present invention.

In FIG. 8, a block representation of the second preferred embodiment is shown. The sensor 10, A/D converter 11, conversion circuit 17, and tone generator 18 shown in the drawing are the same as those employed in the first preferred embodiment of the present invention.

In the second preferred embodiment, the digital position signal output from each A/D converter 11 is supplied to a respective input terminal of each of a pair of comparators, comparator number one 12*a* and comparator number two 12*b*. Each comparator number one 12*a* and comparator number two 12*b* has another input terminal to which a respective reference value is supplied from reference signal generator circuit 13*a*, reference value A1 for comparator number one 12*a*, reference value A2 for comparator number two 12*b*. Each comparator 12*a*, 12*b* compares its respective reference value A1, A2, with the supplied digital signal from A/D converter 11, and at the point when it is judged that the value supplied from A/D converter 11 is greater than the respective reference value A1, A2, a respective judgement signal number one or judgement signal number two is output.

Each of the above mentioned reference values A1, A2 are supplied from reference signal generator circuit 13*a* so as to be different values. Further, these values correspond to values output from the sensors 10 representing the earliest stages of flexion of the respective digits, and thus correspond closely to the onset of digit motion. That is to say, the reference values A1, A2 closely correspond to values output from the sensors 10 very nearly equal to the values corresponding to the smallest detectable amount of flexion. Accordingly, the amount of flexion detected by comparator number one 12*a* and the amount of flexion detected by comparator number two 12*b*, based on comparison with reference values A1, A2 respectively, represent two reference positions of the respective digit, different from, but very nearly equal to the position at the onset of flexion. In the present preferred embodiment, reference value A1 is set so as to be smaller than reference value A2. Thus, for a given sensor 10, the respective digit can be judged to be in one of three position states, that is, the state in which the digital signal corresponding to the position signal output from the respective sensor 10 has exceeded neither reference value A1 nor reference value A2 (referred to as stage 1 hereafter), the state in which the digital position signal has exceeded reference value A1 but not reference value A2 (stage 2), and the state in which the digital position signal has exceeded both reference value A1 and reference value A2 (stage 3).

The output of each comparator 12*a*, 12*b*, that is, judgement signal number one and judgement signal number two respectively is supplied to a respective monostable multivibrator (one-shot circuit), monostable multivibrator number one 60*a* and monostable multivibrator number two 60*b*, wherein the time of the onset of the respective judgement signal number one or judgement signal number two is detected. Between the pair of monostable multivibrators 60*a*, 60*b*, the output signal of monostable multivibrator number one 60*a* is supplied as a reset signal to counter 61, to which a clock pulses P are additionally supplied as a count signal. Thus, in ordinary operation, timer 61 counts clock pulses P until its content is reset by the reset signal from monostable multivibrator number one 60*a*, which is in turn triggered when the onset of judgement signal number one is detected.

The count value output by counter 61 is supplied as input data to register 62, to the load terminal (LT) of which the output signal of the above described monostable multivibrator number two 60*b* is supplied as well. Accordingly, while the count value output by counter 61 and supplied as input data to register 62 is constantly changing based on the supplied clock pulses P, the supplied clock value is maintained only when the signal from monostable multivibrator number two 60*b* has been supplied, which is in turn triggered when the onset of judgement signal number two is detected.

The count value maintained in counter 61 after the signal from monostable multivibrator number two 60*b* has been supplied is in turn supplied to conversion circuit 17, wherein according to an internal data table, the supplied count value is converted to a predetermined value which is the supplied to tone generator 18 as an initial touch response (ITR) signal. The signal supplied to tone generator 18 is converted by conversion circuit 17 to a value suited to the input characteristics of tone generator 18, as will be described in greater detail later.

The tone generator 18 to which the ITR signal from conversion circuit 17 is supplied creates and outputs an appropriate musical signal based on not only the ITR signal, but also on the judgement signal number two output from comparator number two 12*b* which serves as a key-on (KON) signal, and on a signal output from a respective A/D converter 11 expressing the amount of flexion of the respective digit, thus representing an after-touch response (ATR) signal. In tone generator 18, the generation of the musical signal is governed by the KON signal, while the pitch, timbre, volume and other musical characteristics are controlled by the ITR and ATR signals.

In the following section, the operation of the musical control device of the second preferred embodiment will be described.

After a glove unit as shown in FIG. 2 is applied to each of the performer's hands, the plurality of sensors 10 are able to detect the amount of flexion of the performer's respective fingers, and to output appropriate signals based on the detected movement. These output analog position signals are then supplied to respective A/D converters 11, where they converted to respective digital position signals, which are then supplied to a respective comparators 12*a*, 12*b*, as well as to tone generator 18.

Figure 9:
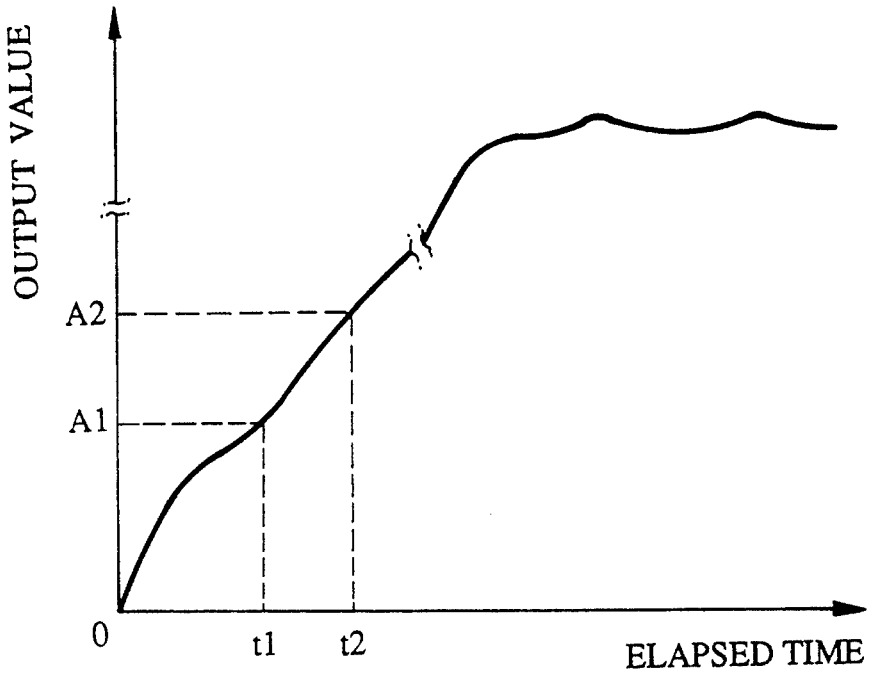
FIG. 9 is a graph showing the relationship between the analog position signal output from a position sensor of the present invention and elapsed time while a digit is being flexed for the second preferred embodiment of the present invention.
Figure 10:
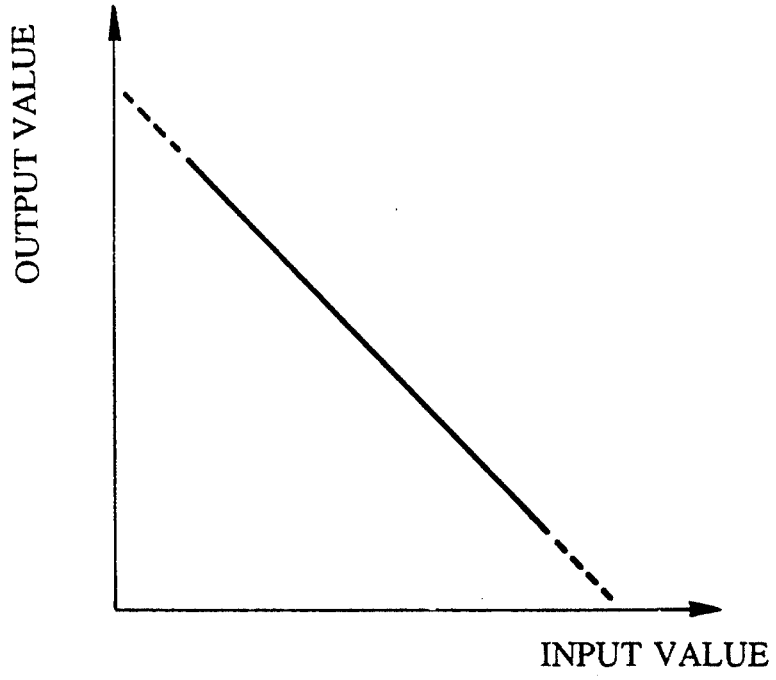
FIG. 10 is a graph illustrating the conversion ratio employed in a conversion circuit of the second preferred embodiment of the present invention.

Referring to FIG. 9, the relationship between the analog position signal value output from a sensor 10 and elapsed time (approximately proportionate to amount of flexion) while a flexion of the respective digit is being carried out can be seen.

As previously explained, based on comparison of the output of the respective A/D converter 11 with the reference values A1, A2, the position state of the flexing digit progresses from a first stage, to a second stage, and to a third stage. At the point (time t1) when the position is reached at which the corresponding output of A/D converter 11 is judged to be greater than the reference value A1, that is, at the point of transition to stage 1 to stage 2, the judgement signal number one is output from comparator number one 12*a*. Then, when monostable vibrator number one 60*a* detects the onset of the judgement signal number one, at that point counter 61 is reset and commences counting clock pulses P from zero, whereby the time interval that has passed since the above described time t1 is determined.

As the respective digit further flexes, at the point of transition from stage 2 to stage 3, that is, when the position is reached at which the digital output of A/D converter 11 corresponding to the analog output of the respective sensor 10 is judged to be greater than the reference value A2 in comparator number two 12*b*, the judgement signal number two is output from comparator number two 12*b*. Then, when monostable vibrator number two 60*b* detects the onset of the judgement signal number two, at that point (time t2), monostable vibrator number two 60*b* supplies a signal to the load terminal LT of register 62, whereby the clock value corresponding to time t2 is then loaded into register 62 from counter 61.

Accordingly, the value loaded into register 62 at time t2 corresponds to the elapsed time from t1 to t2 (t2−t1), that is, the time elapsed as the flexing digit moves from the position corresponding to reference value A1 to the position corresponding to reference value A2. Thus, it can be seen that this value loaded into register 62 becomes smaller with higher velocity of the flexing digit.

However, in the case of initial touch response ITR control, ordinarily the control signals are such that the value is high at high velocities and low at low velocities, which is the case with the ITR signal input characteristics of the tone generator 18 employed in the present preferred embodiment. For this reason, the value in register 62 is converted by conversion circuit 17 to match these input characteristics, that is, small values are converted to larger values and large values are converted to smaller values, which can be seen in the graph of FIG. 10. It is also possible to employ a tone generator 18 in which low values of the ITR signal are recognized to represent high values, and in which high values of the ITR signal are recognized to represent low values, in which case, the above described conversion in conversion circuit 17 is not carried out.

As stated previously, judgement signal number two is also supplied from comparator number two 12*b* to tone generator 18. For this reason, at the point when the flexing digit moves into the above described stage 3 position state, that is, at the point when judgement signal number two is output, tone generator 18 recognizes this as a signal to commence the generation of a musical tone. Accordingly, this signal corresponds to the key-on KON signal. Immediately after the judgement signal number two is detected by tone generator 18, the ATR signal supplied from A/D converter 11 is also input into tone generator 18, whereby the various musical elements of the tone are controlled.

Thus, it can be seen that at the onset of the KON signal, that is, judgement signal number two, generation of the musical tone commences in tone generator 18, and at the same time, the various musical elements of the tone are controlled by the ATR and ITR signals, which continues until the KON signal terminates.

In the musical control device of the present preferred embodiment as was explained previously and as can be seen in FIG. 10, the input and output of conversion circuit 17 are approximately inversely proportional to each other, whereby the output of conversion circuit 17 is converted to a form suited to the input characteristics of tone generator 18. By suitably adjusting the conversion ratio employed by conversion circuit 17, it is possible to optimize the output of conversion circuit 17 so as to suit the performers playing characteristics. For an ITR signal based on the velocity of a portion of a performer's body, the ITR signal can have a directly proportional relationship to the detected velocity, or an inversely proportional relationship. Further, it is also acceptable for the ITR signal and velocity to have a fixed corresponding relationship.

By simultaneously adjusting the values of A1 and A2 so that the difference between the two remains constant, it is further possible to thereby control the amount of flexion of a given digit required to generate the key-on signal KON.

By supplying the previously described KON signal to reference signal generator circuit 13*a*, and by causing the value of reference signal A0 to be slightly reduced during the interval when the KON signal is being output, it is possible to create a hysteresis effect on the detection of on-off states during the detection of musical timing signals. That is to say, by causing the value of the reference signal A0 when a KON signal changes from on to off to be slightly lower than when the KON signal changes from off to on, judgement errors can be reduced.

In the present preferred embodiment, two reference values were employed corresponding to two positions between which the velocity of the flexing digit is determined. It is possible, however, to provide three or more reference values with corresponding digit positions whereby determination of the velocity of the flexing digit at a plurality of positions can be achieved, thus providing finer control. By so obtaining two or more velocity values at different positions, it becomes possible to determine acceleration of the digit as well, upon which basis further control of the musical tone can be achieved.

In the second preferred embodiment as described above, separate circuitry was employed for each sensor. Thus for a musical control device with control based on the movement of five digits of one hand, five sets of detection circuitry would be required. However, by using time-slicing techniques, it is possible to configure the musical control device of the present preferred embodiment in which only one circuit is employed for a plurality of sensors.

What is claimed is:

1. A musical control device comprising:

position detection means for detecting position whereby an amount of flexion of a portion of a performer's body is detected and is output as a position signal;

velocity detection means for detecting velocity whereby a velocity of the portion of the performer's body is detected and output as velocity data based on the change in said position signal; and musical control signal output means for generating and outputting a musical control signal based on said position signal and velocity data.

2. A musical control device in accordance with claim 1 above in which said position detection means detects the position of a performers digit.

3. A musical control device in accordance with claim 1 above wherein said velocity detection means in such that the velocity value determined therein is based on a measurement of the time interval over which the position expressed by the signal output from said position detection means varies from a first predetermined value to a second predetermined value which is different from said first predetermined value.

4. A musical control device in accordance with claim 3 above wherein said velocity detection means further comprises:

reference signal generation means for generating reference signals wherein said first predetermined value and said second predetermined value are generated;

first comparison means for detecting the point at which said first predetermined value and the output of said position detection means become equal whereupon a first judgement signal is output;

second comparison means for detecting the point at which said second predetermined value and the output of said position detection means become equal whereupon a second judgement signal is output; and time measuring means for measuring time, wherein the time interval between when said first judgement signal is output and when said second judgement signal is output is measured.

5. A musical control device as set out in claim 1, wherein said position detection means is adapted to be attached to said portion of a performer's body.

6. A musical control device comprising:

position detection means for detecting position, whereby the amount of flexion of a portion of a performer's body is detected as the position and output as a position signal;

velocity detection means for detecting velocity, having:

(a) reference time detection means for detecting a reference time, wherein the point in time at which said portion of said performer's body flexes past a predetermined position is detected based on the output of said position detection means, and (b) displacement detection means for detecting displacement whereby said position signal output from said position detection means is determined after a predetermined time interval after said point of time detected by said reference time detection means; and musical control signal output means for generating and outputting a musical control signal based on said position signal and velocity data.

7. A musical control device in accordance with claim 6 above wherein said reference time detection means further comprises:

first reference signal generation means for outputting a first reference signal of a predetermined value; and first comparison means for detecting the point at which the output of said first reference signal generation means and the output of said position detection means become equal.

8. A musical control device in accordance with claim 6 above wherein said displacement detection means further comprises:

timer means for timing, whereby a predetermined time interval is measured after said reference time is detected by said reference time detection means; and latch means for latching a signal, whereby the output of said position detection means is read at the moment when said end of said predetermined time interval has been measured.

9. A musical control device as set out in claim 6, wherein said position detection means is adapted to be attached to said portion of a performer's body.

* * * * *